US005173056A

United States Patent [19]

Kniese et al.

[11] Patent Number: 5,173,056

[45] Date of Patent: Dec. 22, 1992

[54] MULTIPOLE PLUG-IN CONNECTOR

[75] Inventors: Wolfgang Kniese; Otto Schempp, both of Bad Rappenau, Fed. Rep. of Germany

[73] Assignee: Molex Incorporated, Lisle, Ill.

[21] Appl. No.: 751,496

[22] Filed: Aug. 29, 1991

[51] Int. Cl.[5] ..... H01R 9/09; H01R 23/70

[52] U.S. Cl. ..... 439/79

[58] Field of Search ..... 439/79, 80, 629, 630

[56] References Cited

U.S. PATENT DOCUMENTS 3,384,864 5/1968 Schwartz ..... 439/629

OTHER PUBLICATIONS

IBM Bulletin, Double-Sided Right Angle Pin Connector, vol. 31, No. 5, p. 73, Oct. 1988.

*Primary Examiner*—Neil Abrams

*Attorney, Agent, or Firm*—A. A. Tirva

[57] ABSTRACT

A right-angle printed circuit board connector includes a plurality of contacts arranged in a matrix having portions of the contacts extending from the connector terminating in a corresponding plurality of conductive areas laid out in a matrix on the printed circuit board. The extending contact portions are arranged such that the uppermost row is terminated in apertures located closest to the connector and the lowermost row is connected to apertures located the farthest from the connector - the length of all the individual being substantially equal.

5 Claims, 1 Drawing Sheet

MULTIPOLE PLUG-IN CONNECTOR

TECHNICAL FIELD

The invention relates to a multi-contact electrical connector for mounting on a printed circuit board and specifically to a right angle connector having contact legs engaging conductive areas on the printed circuit board laid out in a matrix with a predetermined grid spacing.

BACKGROUND OF THE INVENTION

Right angle multi-contact printed circuit board connectors having contacts connected to conductive areas on a printed circuit board arranged in a matrix with a predetermined grid spacing are known in the art and are disclosed, for example, in U.S. Pat. No. 4,834,662 issued to one of the applicants of the subject application, the disclosure of which patent is incorporated herein by reference. Because of the geometry of the right angle connector, contact portions or legs are required to extend from the back of the connector housing to establish electrical connections to the conductive areas on the printed circuit board. Present arrangements have contact legs extending from the lowermost row of the connector contacted the conductive areas on the printed circuit board located closest to the connector housing and contact legs of the uppermost rows overlapping the lower legs and connecting to conductive areas located farthest away from the connector housing. The result is that the actual lengths of the individual contact legs located in different rows are not the same.

While this type of a connecting arrangement has been satisfactory for most of the prior art electrical circuit applications, the varying length of the contact legs results in different signal delay times for signals passing through the connector. With ever shorter switching times of active electronic elements and circuits, this becomes a problem and consequently, either phase shifting of signal trains have to be accepted or other measures to compensate for signal delayed times must be considered.

SUMMARY OF THE INVENTION

In accordance with the present invention, the prior art problem is solved by providing a multi-contact electrical connector of the type mentioned before wherein the length of individual contact legs is substantially the same.

This advantageous structural arrangement is achieved by having the contact legs extending from the topmost row of contacts in the connector housing mate with a row of conductive areas on the printed circuit board which is located closest to the connector housing, and the contact legs extending from the lowermost row of the contacts mate with the row of conductive areas on the printed circuit board located farthest away from the connector housing. Contact between overlapping contact legs of different rows is avoided by lateral offset of individual connector legs.

BRIEF DESCRIPTION OF THE DRAWINGS

The invention and specific details are explained in more detail below with reference to the drawing, in which.

DETAILED DESCRIPTION

Figure 1:
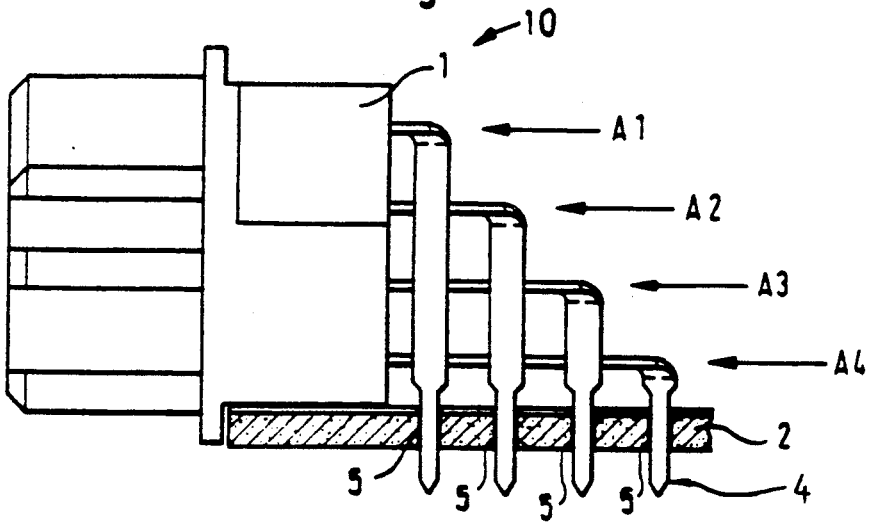
FIG. 1 shows a partial schematic left side view of a multi-contact connector with connector contact legs formed according to the invention.

An electrical connector 10, as shown in FIG. 1, has a housing 1 mounted on the edge region of a printed circuit board 2. Extending from the connector housing 2 are four rows Al to A4 of connector contacts 4, each row arranged one above the other. The printed circuit board 2 has a plurality of plated through holes 5 (only four of the holes are shown) laid out in a matrix of rows and columns with predetermined grid spacing. The contacts 4 of the uppermost row Al extend to the row of holes 5 located closest to the connector housing 1. The contacts 4 of the second row A2 extend to the next row of holes spaced farther away from the housing 1 continuing in such a way that the lowermost row A4 of contacts 4 is connected to the holes 5 which are spaced farthest away from the connector housing 1.

Figure 2:
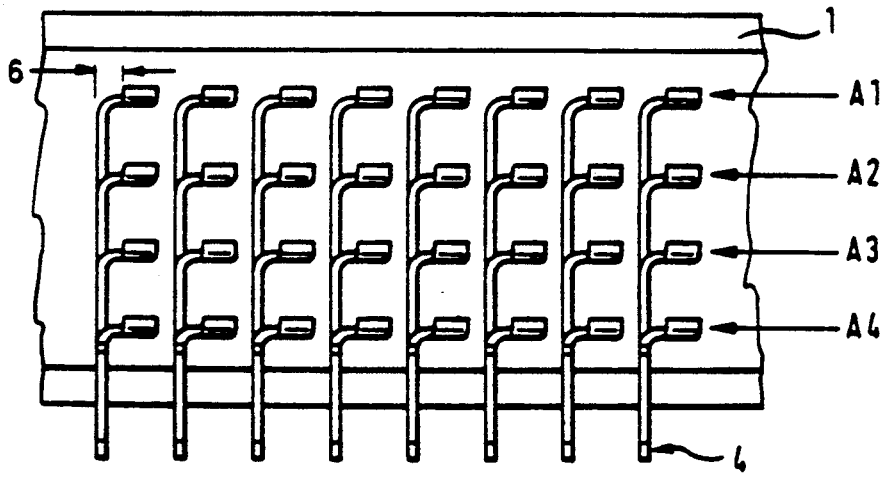
FIG. 2 shows a partial back view of the connector shown in FIG. 1 and viewed from the right.
Figure 3:
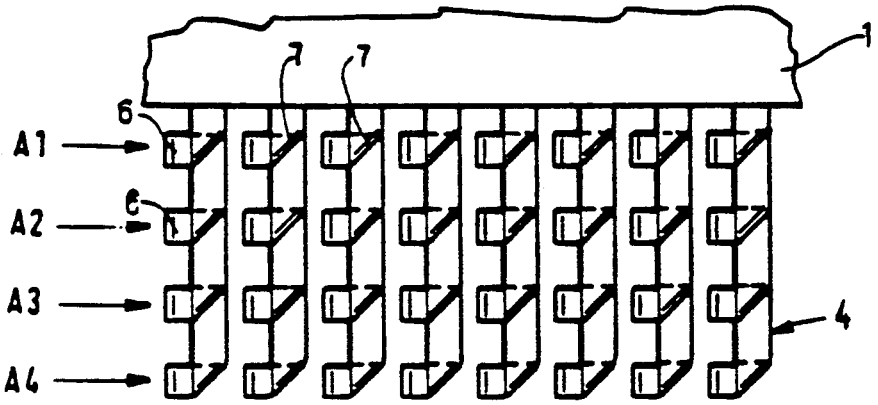
FIG. 3 shows a partial schematic representation of the top view of the connector shown in FIG. 1.

According to the preferred embodiment of the invention, the contacts 4 are made of flat metallic strips having a major surface of the portion of each contact 4 extending from the housing 1 parallel to the top surface of printed circuit board 2. In order to allow the contacts 4 of the uppermost row Al to mate with the holes closest to the housing 1 without interfering with the contacts 4 of rows A2 through A4, each individual contact 4 is set off a predetermined distance 6 as shown in FIGS. 2 and 3. The set-off is accomplished by bending the free end of each contact 4 down and under the portion of the contact extending from the housing 1, the bend forming a line 7 (shown in FIG. 3) at substantially a 45° angle. Then, after measuring set off 6 the free end of the contact is bent downwards toward the printed circuit board at an angle of substantially 90° positioning the free end of the contact over its respective hole 5.

With the given grid spacing of the holes 5 on the printed circuit board 2, and the distances between the contacts 4 in the connector housing 1 as evident from FIG. 1, the portion of each contact 4 of row Al extending from the housing 1 is the shortest and the bent over portion of the contact leading towards the circuit board 2 is the longest. Conversely, for the row A4, the portion of each contact 4 extending from the housing 1 is the longest and the bent over portion leading toward the circuit board 2 is the shortest.

Accordingly, the length of the portions of the contacts 4 extending from the connector housing 1 of the first, second, third and fourth row A1, A2, A3 and A4, respectively, is chosen approximately in inverse ratio to the length of the portions of the contacts bent towards the circuit board. As a result, approximately equal overall lengths are obtained for all connector contacts and extending from the housing 1 and consequently, the delay times of signals transmitted via each individual contact 4 are also approximately the same.

We claim:

1. A right angle electrical connector comprising a housing adapted for mounting on a printed circuit board, a plurality of substantially identical contacts mounted in the housing and arranged in a matrix of rows and columns the rows arranged one above the other, each contact having a portion extending away from the housing and terminating in a free end, a plurality of conductive areas located on the printed circuit board and arranged in a matrix of rows and columns, the contact portions extending from the housing in each column are mutually offset and formed to connect their free ends to predetermined conductive areas located in the same column on the printed circuit board, wherein all the individual contact portions are of substantially the same length wherein the uppermost row of contacts in the housing located the farthest from the printed circuit board is connected to conductive areas located in a row on the board located closest to the housing, and the lowermost row of contacts in the housing located closest to the printed circuit board is connected to conductive areas located in a row on the board located the farthest away from the housing, wherein the extending contact portions located in the same column in the housing are formed with a predetermined offset such that overlapping contact portions do not come in contact with each other and the free end of each contact is located above a predetermined conductive area located in a corresponding column of conductive areas, wherein the contacts are of flat metallic strips and the contact portions extending from the housing have a major surface substantially parallel to the surface of the printed circuit board, and wherein the offset is formed by bending the free end of the contact down and positioning it under the contact portion extending from the housing, the bent down portion forming a substantially 45° angle with the portion of the contact extending from the housing, and further bending the free end at a predetermined location at a substantially right angle down towards the surface of the printed circuit board.

2. The electrical connector of claim 1, wherein the contact portion positioned under the contact portion extending from the housing extends in a direction substantially normal to the direction of the contact portion extending from the housing.

3. The electrical connector of claim 1, wherein the lengths of the contact portions extending from the housing are in inverse ratio to the length of the contact portions extending downward towards the printed circuit board.

4. The electrical connector of claim 1, wherein the metallic strips are of a uniform cross-section.

5. The electrical connector of claim 1, wherein the matrix of contacts in the connector housing is substantially identical to the matrix of the conductive areas located on the printed circuit board.

* * * * *